United States Patent [19]

Rose

[11] Patent Number: 4,722,693

[45] Date of Patent: Feb. 2, 1988

[54] SAFETY SHUTTERS FOR ELECTRICAL RECEPTACLES

[76] Inventor: Friedhelm Rose, 55 Cache Cay, Vero Beach, Fla. 32963

[21] Appl. No.: 31,894

[22] Filed: Mar. 30, 1987

[51] Int. Cl.[4] ..... H01R 13/44

[52] U.S. Cl. ..... 439/137; 439/139

[58] Field of Search ..... 439/137, 139, 140, 141, 439/143, 145

[56] References Cited

U.S. PATENT DOCUMENTS

| | | | |
|---|---|---|---|
| 2,926,327 | 2/1960 | Metelli | 439/139 |
| 3,222,631 | 12/1965 | Cohen | 439/137 |
| 3,238,492 | 3/1966 | Houston | 439/137 |
| 3,986,763 | 10/1976 | Sparrow | 439/137 |
| 4,072,382 | 2/1978 | Reschke | 439/143 |
| 4,168,104 | 9/1979 | Buschow | 439/137 |
| 4,271,337 | 6/1981 | Barkas | 439/137 |
| 4,379,607 | 4/1983 | Bowden, Jr. | 439/137 |
| 4,544,219 | 10/1985 | Barkas | 439/137 |

*Primary Examiner*—Gil Weidenfeld
*Assistant Examiner*—Paula A. Austin
*Attorney, Agent, or Firm*—Carroll F. Palmer

[57] ABSTRACT

A safety shutter for an electrical receptacle is in the form of a sliding rocker with a pair of angled lugs on the front side and a slot that can mate with one of two electric plug receiving slots in the faceplate of the electrical receptacle and is biased by a spring into a safety position wherein such receiving slot is out of alignment with the shutter slot. The shutter slot may move into alignment with such receiving slot when an electric plug is inserted into the receptacle to simultaneously engage the angled lugs. However, the shutter rocks without sliding when a single foreign object is inserted through either of the faceplate receiving slots and engages only one of the lugs whereby the foreign object is prevented from reaching the internal contacts of the receptacle.

4 Claims, 15 Drawing Figures

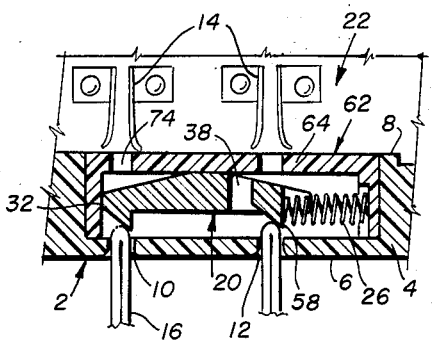
FIG. 5
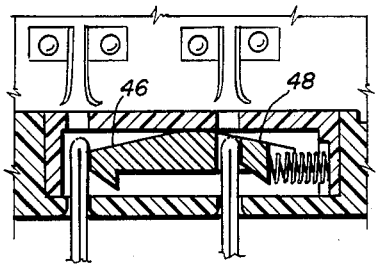
FIG. 6
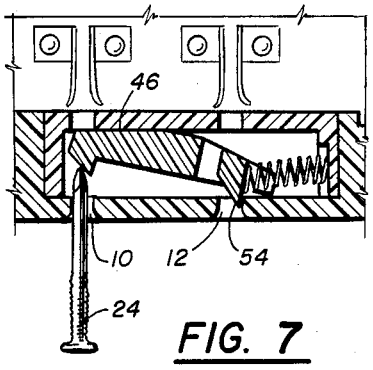
FIG. 7
FIG. 8
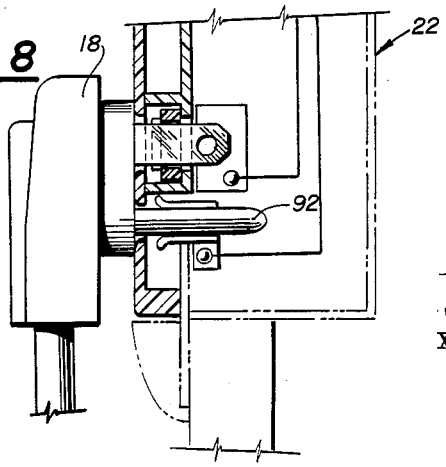
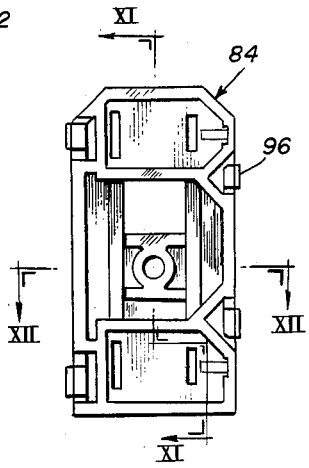
FIG. 9
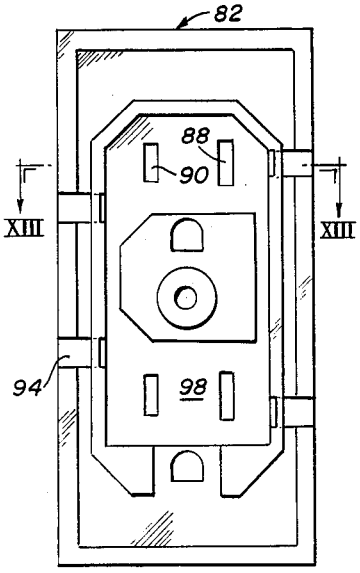
FIG. 10
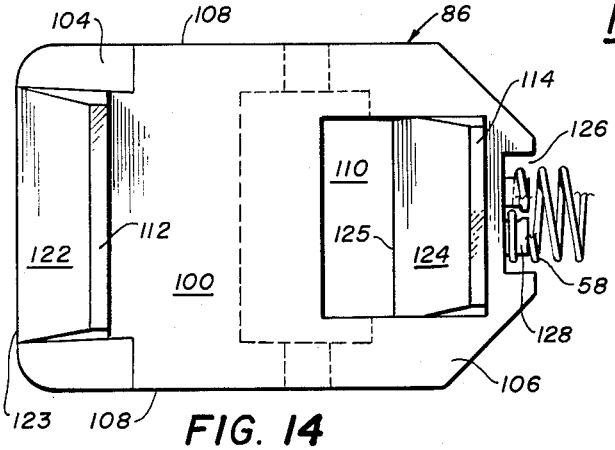
FIG. 14
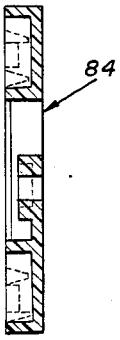
FIG. 11
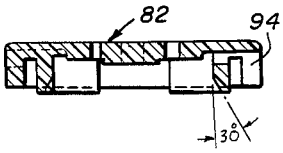
FIG. 13
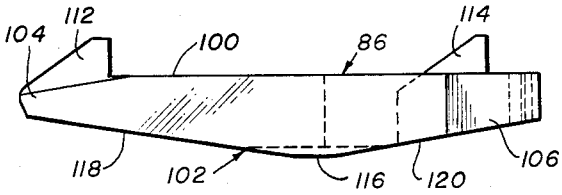
FIG. 15
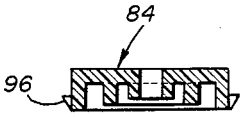
FIG. 12

SAFETY SHUTTERS FOR ELECTRICAL RECEPTACLES

BACKGROUND OF THE INVENTION

1. Field of the Invention

This invention relates broadly to electrical receptacles into which connector plugs are inserted to supply current to the power cord to which the plug is connected. More particularly, it concerns safety shutters for such receptacles which prevent a foreign object, e.g., a nail, when inserted into the receptacle form reaching the energized internal contacts of the receptacle.

2. Description of the Prior Art

Children and others frequently attempt to put foreign objects, such as nails, into electrical receptacles resulting on occasion in serious injury. Hence, a host of "safety" receptacles have been developed to prevent such improper entry which can be divided into several general classes. One class is the internal switch type which does not inhibit the insertion of foreign objects, but rather permit the existence of voltage in the receptacle only when is is properly used (see U.S. Pat. No. 4,271,337).

Another class is the "shuttered" type in which the insertion of anything other than the blades of an correct electrical plug is inhibited by some shutter means positioned behind the faceplate. Examples of such type receptacles are disclosed in the following patents.

U.S. Pat. Nos. 2,528,014, 4,168,104 3,238,492, 4,271,337 3,986,763, 4,379,607 4,072,382, 4,544,219.

The present invention provides an improved form of the shuttered type electrical receptacle.

OBJECTS

A principle object of the invention is provision of improved forms of safety shutters for electrical receptacles.

Further objects include the provision of:

1. Improved electrical receptacles having internal safety shutters that keep the receptacle slots automatically closed except upon the insertion of an appropriate electrical plug.
2. Means to prevent children and others from inserting nails, paper clips and like foreign objects to reach the energized contacts within the receptacle.
3. Such means that is of simple construction, inexpensive to manufacture and highly effective in operation.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision, in electrical receptacles including a faceplate having a front surface, a rear portion and at least first and second spaced slots that align with internal contacts for receiving contact blades of an electric plug, of improved safety shutters which allow users to insert an appropriate electrical plug into the receptacle with a single thrusting motion while preventing a foreign object from being inserted through either of the slots simply to reach the internal contacts of the receptacle. Such new safety shutters are positioned in the rear portion of the faceplate of the receptacle and a spring biases the shutter into a slot obstructing position.

The new shutters comprise a front surface, a rear surface, a first end, a second end, a pair of parallel longitudinal sides and an elongated slot extending through the shutter and the surfaces with its longitudinal axis normal to the sides. The front surface is substantially flat except for first and second lugs that project therefrom.

The rear surface of the shutter has a flat central rectangular portion that is parallel to the front surface, a first flat portion extends from the central portion to the first end and a second flat portion extends from the central portion to the second end, the first and second portions being angled relative to the central portion, creating, in effect, a rocker surface.

The first lug on the front surface of the shutter has a flat surface, one side of which is conterminal with and angled downwardly toward the first end of the shutter. The second lug also has a flat surface, one side of which is conterminal with an angled downwardly toward the elongated slot in the shutter.

In preferred embodiments, the bias spring is a coil spring one end of which pushes against the second end of the shutter to bias the shutter into a closed position wherein its elongated slot is out of alignment with the second spaced slot in the faceplate, but permits the elongated slot to move into alignment with the second spaced slot when an electric plug is inserted into the receptacle.

Also, the second end of the shutter includes a notch to receive the one end of the coil spring. Further, the new receptacles of the invention have a cage member which nests in the back portion of the faceplate to capture the shutter so the rear surface thereof faces toward and engages the cage member.

BRIEF DESCRIPTION OF THE DRAWINGS

A more complete understanding of the invention may be had by reference to the accompanying drawings in which:

FIG. 5 is a fragmentary sectional view taken on the line V—V of FIG. 1 showing an electrical plug starting to be inserted into the faceplate.

FIG. 6 is a fragmentary sectional view similar to FIG. 5 showing the electical plug further inserted into the faceplate.

FIG. 7 is a fragmentary sectional view similar to FIG. 5 showing a nail attempted to be inserted into the faceplate, but inhibited by the safety shutter.

FIG. 8 is a lateral sectional view showing a three-pronged electrical plug inserted into an electrical receptacle of the invention.

FIG. 9 is plan view of a second embodiment of a cage member for the new electrical receptacles of the invention.

FIG. 10 is a rear view of a faceplate designed to function with the cage member of FIG. 9.

FIG. 11 is a sectional view taken on the line XI—XI of FIG. 9.

FIG. 12 is a sectional view taken on the line XII—XII of FIG. 9.

FIG. 13 is a sectional view taken on the line XIII—XIII of FIG. 10.

FIG. 14 is an enlarged plan view of a second embodiment of a safety shutter of the invention.

FIG. 15 is a lateral view of the safety shutter of FIG. 14.

DESCRIPTION OF THE PREFERRED EMBODIMENTS

Figure 1:
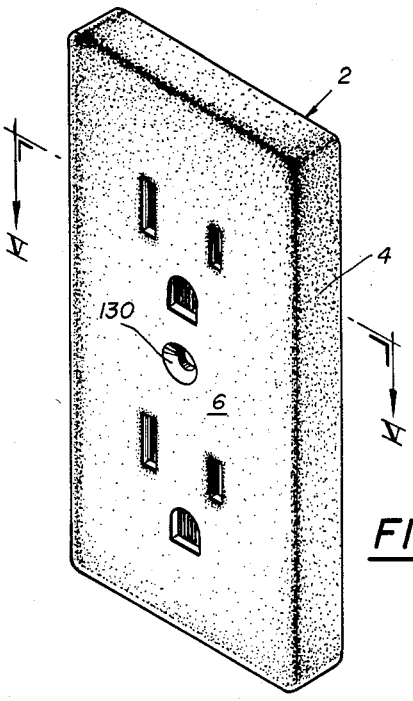
FIG. 1 is a front perspective view of an electrical receptacle faceplate and safety shutter combination structured in accordance with the invention.
Figure 2:
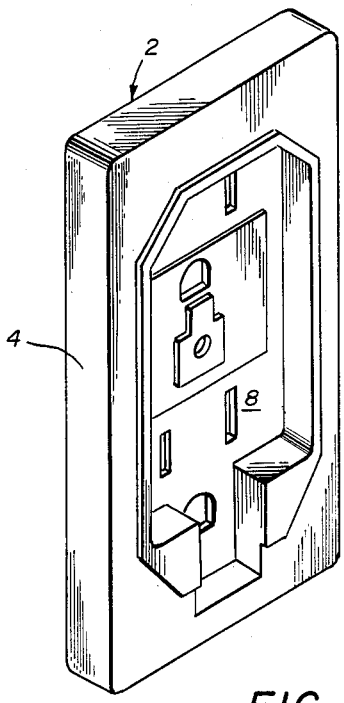
FIG. 2 is a rear perspective view of the faceplate shown in FIG. 1.
Figure 4:
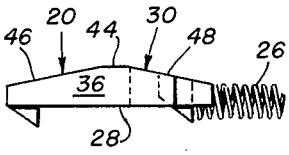
FIG. 4 is a lateral view of the safety shutter shown in FIG. 3.
Figure 3:
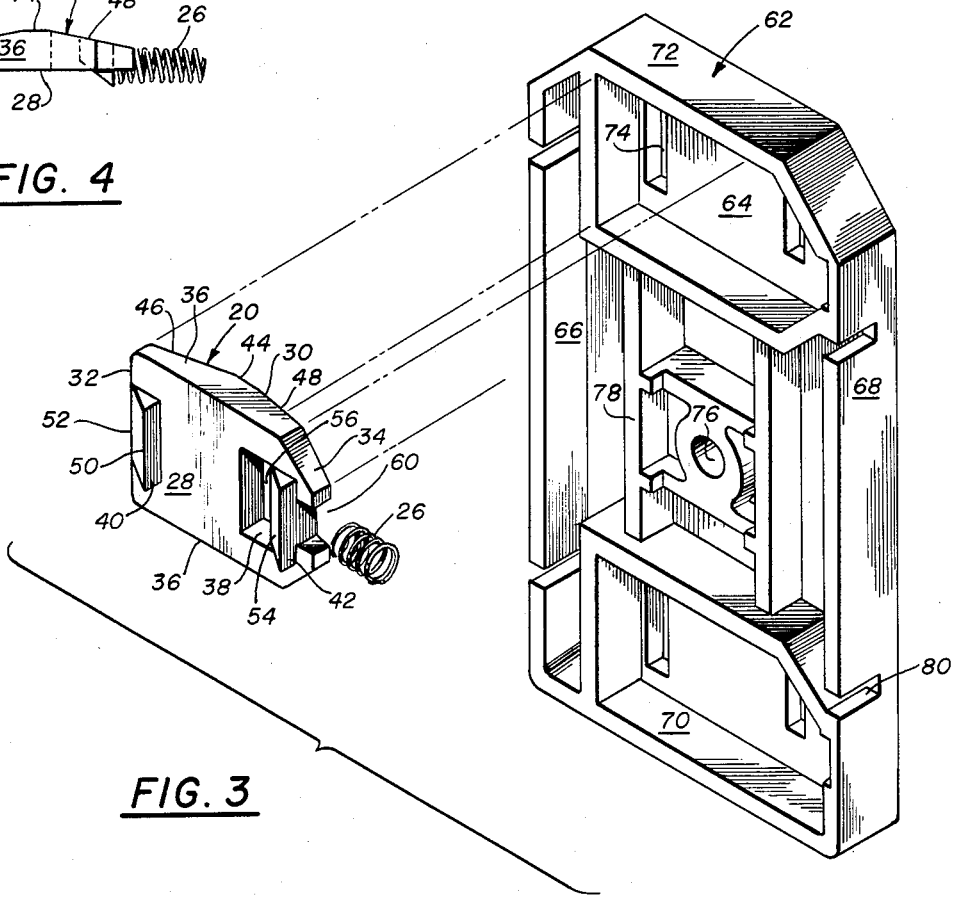
FIG. 3 is an exploded view of a safety shutter of the invention and its related cage member.

Referring in detail to the drawings, in which identical parts are identically marked, the new electrical receptacle safety devices 2 comprise a faceplate 4 having a front surface 6, a rear portion 8 and first and second spaced slots 10 & 12 that align with internal contacts 14 for receiving contact blades 16 of an electric plug 18 and a safety shutter 20.

As illustrated by FIGS. 5-7 the shutter 20 allows blades 16 of the plug 18 to be inserted into the receptacle 22 with a single thrusting motion while preventing a foreign object, e.g., nail 24, from being inserted through either of the slots singly to reach the internal contacts 14.

The safety shutter 20 is positioned in the rear portion 8 of the faceplate 4 and a coil spring 26 biases the shutter into a slot obstructing position as seen in FIG. 5.

The shutter 20 has a front surface 28, a rear surface 30, a first end 32, a second end 34, a pair of parallel longitudinal sides 36 and an elongated slot 38 extending through the shutter 20 and the surfaces 28 and 30 with its longitudinal axis normal to the sides 36.

The front surface 28 is substantially flat except for first lug 40 and second lug 42 which project therefrom.

The rear surface 30 has a flat central rectangular portion 44 that is parallel to the front surface 28, a first flat portion 46 that extends from the central portion 44 to the first end 32 and a second flat portion 48 that extends from the central portion 44 to the second end 34. The portions 46 & 48 are angled relative to the central portion 44 in effect creating a rocker unit.

The first lug 40 has a flat surface 50, one side 52 of which is conterminal with an angled downwardly toward the first end 32. The second lug 42 also has a flat surface 54, one side 56 of which is conterminal with and angled downwardly toward the elongated slot 38.

As shown in FIGS. 5-7, the end 58 of spring 26 pushes against the second end 34 to bias the shutter 20 into a closed position wherein the elongated slot 38 is out of alignment with the second spaced slot 12, but permits the elongated slot 38 to move as shown in FIG. 6 into alignment with the slot 12 when prongs 16 of the electric plug 18 are inserted into the receptacle 22. As shown in FIG. 7, when a foreign object is insert into a single one of the slots 10 or 12, this causes the shutter 22 to rock onto one of the angled portions 46 or 48. If the object 24 enters slot 10, the shutter 20 rocks onto the portion 46 which locks the lug 54 in the slot 12 thereby preventing the shutter from sliding to the right and the object 24 from moving further into the receptacle 22. If the object 24 enters slot 12 (not shown), the shutter 20 will rock onto portion 48 and, since end 32 abuts a surface, the shutter 20 can not move to the left and the object 24 is prevented from moving further into the receptacle 22.

The second end 34 includes a notch 60 to receive the end 58 of the spring 26.

The cage member 62 nests in the back portion 8 of the faceplate 4 to capture the shutter 20 so its rear surface 30 faces toward and engages the cage member 62.

The cage member 62 comprises a back 64, sides 66 & 68, a first end 70, a second end 72, prong insertion slots 74, a fastener hole 76 reinforced by a network of webs 78 and a plurality of slots 80 in the sides 66 and 68. The slots 80 provide flexibility to the portion of the sides 66 and 68 that lies between the slots when the cage member 62 is forced into the back portion 8 of the faceplate 4.

Second embodiments of the invention are shown in FIGS. 9-15, namely, a faceplate 82 in FIG. 10, cage member 84 for nesting in faceplate 82 in FIG. 11 and a shutter 86 in FIGS. 14 and 15.

Faceplate 82 is basically like faceplate 4. Its slots 88 and 90 are different in size to accommodate the type of electrical plugs (not shown) that do not use a grounding prong 92 as in the case of plug 18. Also, it has side apertures 94 to receive tangs 96 used to lock the cage member 84 into the back portion 98 of the faceplate 82

The shutter 86 has a front surface 100, a rear surface 102, a first end 104, a second end 106, a pair of parallel longitudinal sides 108 and an elongated slot 110 extending through the shutter 86 and its surfaces 100 and 102 with its longitudinal axis normal to the sides 108.

The front surface 100 is substantially flat except for first lug 112 and second lug 114 which project therefrom.

The rear surface 102 has a flat central rectangular portion 116 that is parallel to the front surface 100, a first flat portion 118 that extends from the central portion 116 to the first end 104 and a second flat portion 120 that extends from the central portion 116 to the second end 106. The portions 118 and 120 are angled relative to the central portion 116 in effect creating a rocker unit.

The first lug 112 has a flat surface 122, one side 123 of which is conterminal with and angled downwardly toward the first end 104. The second lug 114 also has a flat surface 124, one side 125 of which is conterminal with and angled downwardly toward the elongated slot 110.

The shutter end 106 includes a notch 126 into which the spring end 58 extends to fit over and be retained by the ears 128.

The new safety shutter units 2 of the invention may be easily installed in electrical receptacles existing in a dwelling or other building. To do this, the existing faceplate (not shown) is removed by unscrewing the conventional single, central screw fastener, the new shutter device 2 is put in place over the existing receptacle and the screw fastener (not shown) is inserted into the central hole 130 and tightened to fix the unit 2 onto the receptacle 22. Advantageously, the new units 2 are molded from rigid phenolic or like plastic, but then can be formed of stamped or cast metal, rubber, ceramic or other suitable material.

The embodiments of the invention in which an exclusive property or privilege is claimed are defined as follows:

1. In an electrical receptacle including a faceplate having a front surface, a rear portion and at least first and second spaced slots that align with internal contacts for receiving contact blades of an electric plug, the improvement which allows a user to insert said plug into said receptacle with a single thrusting motion while preventing a foreign object from being inserted through either of said slots singly to reach said internal contact, which comprises:

a safety shutter positioned in said rear portion of said faceplate and a spring that biases said shutter into a slot obstructing position, said shutter comprising:

a front surface, a rear surface, a first end, a second end, a pair of parallel longitudinal sides and an elongated slot extending through said shutter and said surfaces with its longitudinal axis normal to said sides, said front surface being substantially flat except for first and second lugs projecting therefrom, said rear surface having a flat central rectangular portion that is parallel to said front surface of said shutter, a first flat portion that extends from said central portion to said first end and a second flat portion that extends from said central portion to said second end, said first and second portions being angled relative to said central portion, said first lug having a flat surface, one side of which is conterminal with and angled downwardly toward said first end, said second lug having a flat surface, one side of which is conterminal with and angled downwardly toward said elongated slot.

2. The receptacle of claim 1 wherein said spring is a coil spring one end of which pushes against said second end to bias said shutter into a closed position wherein said elongated slot is out of alignment with said second spaced slot but permits said elongated slot to move into alignment with said second spaced slot when an electric plug is inserted into said receptacle.

3. The receptacle of claim 2 wherein said second end includes a notch to receive said one end of said spring.

4. The receptacle of claim 1 having a cage member which nests in said rear portion of said faceplate to capture said shutter so said rear surface thereof faces toward and engages said cage member.

* * * * *